350-96.1 SR

3/10/81 XR 4,255,780

United States Patent [19]

Sakellaris

[11] 4,255,780

[45] Mar. 10, 1981

[54] ILLUMINATION ASSEMBLY FOR USE WITH ELECTRICAL TERMINAL UNITS

[76] Inventor: Peter C. Sakellaris, 7315 SW. 33rd, Portland, Oreg. 97219

[21] Appl. No.: 48,491

[22] Filed: Jun. 14, 1979

[51] Int. Cl.[3] ..... H01H 9/18; F21V 33/00

[52] U.S. Cl. ..... 362/32; 362/95; 350/96.10; 200/310

[58] Field of Search ..... 362/32, 95, 455, 456; 200/310, 311, 312, 313, 314, 315, 316, 317; 350/96.10, 96.18, 96.15

[56] References Cited

U.S. PATENT DOCUMENTS

| | | | |
|---|---|---|---|
| 2,134,695 | 11/1938 | Bigman | 362/95 |
| 2,580,056 | 12/1951 | Wheeler | 362/95 |
| 2,612,597 | 9/1952 | Sherrard | 362/95 |
| 3,654,452 | 4/1972 | Frey | 362/32 |
| 3,936,795 | 2/1976 | Nishioka et al. | 362/32 |

*Primary Examiner*—L. T. Hix
*Assistant Examiner*—Alan Mathews
*Attorney, Agent, or Firm*—Kolisch, Hartwell & Dickinson

[57] ABSTRACT

An illumination assembly for facilitating visual determination of the situs of an electrical terminal unit, the unit being mountable on a wall with a removable cover plate positioned in front thereof. The illumination assembly includes a light source for mounting adjacent the unit and behind the cover plate operable for producing illumination and an optical fiber communicating with the light source for transmitting illumination outwardly from the cover plate. Additionally, there is provided a transparent display element which is disposed adjacent the end of the optical fiber for concentrating illumination transmitted by the optical fiber and for also mounting the cover plate adjacent the unit.

13 Claims, 3 Drawing Figures

ILLUMINATION ASSEMBLY FOR USE WITH ELECTRICAL TERMINAL UNITS

BACKGROUND AND SUMMARY OF THE INVENTION

The present invention relates to electrical terminal units which are conventionally used with light switches or electrical plug receptacles, and more particularly to a novel assembly providing illumination for facilitating visual determination of a terminal unit.

It is a common and frustrating experience for an individual to enter a darkened room and search, without success, for the location of a light switch or electrical receptacle. For instance, a room light switch may not be positioned near a door, and prior knowledge of the location of the light switch is necessary in order for an individual to locate same. Additionally, electrical receptacles are generally mounted near the bottom portion of a wall (or on the floor) and it may be an exceedingly difficult task to find such a receptacle in a darkened room.

Additionally, in large rooms such as auditoriums, a gang of light switches may be provided with a selected switch operable for lighting a selected light or lights. If an individual enters such a darkened auditorium it may be quite difficult if not impossible to determine the location or situs of a desired light switch. Of course, if a light switch situs is unknown, and an individual seeks to visually determine the location of an electrical receptacle, the darkened room presents a substantial obstacle in determining the situs of the receptacle.

The problem in visually determining the situs of a wall light switch is recognized in the prior art, and various solutions for providing a locator light or other illumination on the light switch have been suggested. Exemplary of such a proposed solutions is U.S. Pat. No. 2,134,695 which discloses an illuminating attachment for switch devices. However, the attachment disclosed therein requires the provision of a hollow casing for mounting a neon light or glow lamp on the exterior of a light switch cover plate. The attachment must be mounted over the cover plate and interferes with the overall image presented by the cover plate.

Another example of a prior art device for facilitating location of a wall switch plate is set forth in U.S. Pat. No. 2,580,056. This patent discloses a cover plate which is modified to include an extending reflecting bulged portion mounted adjacent the top of the cover plate. The bulged portion is provided with a cavity or recess which accommodates reception of a glow lamp or neon bulb. Of course, the bulged portion requires the use of a separate, especially fabricated cover plate. This is disadvantageous from a cost standpoint and may not be esthetically pleasing.

Accordingly, it is an object of the present invention to provide an illumination assembly for use with an electrical terminal unit (such as a light switch or electrical receptacle) having a removable cover plate for facilitating visual determination of the situs of the unit which includes a light source mounted adjacent the unit operable for producing illumination. An optical fiber means communicates with the light source for transmitting illumination outwardly from the cover plate. It is contemplated that the assembly of the present invention will be supplied as a "retrofit" and that no modification of the terminal unit, junction box or cover plate is necessary in order to accommodate the assembly of the present invention. The light source is preferably connected by means of conductors to the terminals of the terminal unit.

Another object of the present invention is to provide an assembly, as described above, with an optical fiber means dimensioned lengthwise for extending through an aperture provided in the cover plate. The aperture is that which normally accommodates reception of a fastener for mounting the cover plate adjacent the terminal unit. Thus, by removing the fastener and extending the optical fiber means through the aperture in the cover plate, light may be directed from the light source exteriorly of the unit without any modification either to the unit or to the cover plate.

Still another object of the present invention is to provide an illumination display means having a first threaded portion for positioning through the aperture which receives the optical fiber means within an elongate bore provided in the threaded portion. The threaded portion is suitably threadably attached to a mounting provided on the terminal unit or junction box which would normally accommodate reception of a fastener.

Still another object of the present invention is to provide an assembly, as described above, in which the light source is encased in a dark or opaque casing provided with an aperture extending therethrough for receiving the optical fiber means. Accordingly, it is a simple matter to adapt the assembly of the present invention in an existing terminal box.

These and additional objects and advantages of the present invention will be more readily understood after a consideration of the drawings and the detailed description of the preferred embodiment.

DETAILED DESCRIPTION OF THE PREFERRED EMBODIMENT

As mentioned previously, the present invention is directed to a novel illumination assembly for facilitating visual determination of the situs of an electrical terminal unit. In this connection, it is to be noted that the expression "electrical terminal unit" refers to some type of housing which includes electrical terminals for connection to a light switch or electrical receptacle. A typical light switch including a cover plate and a typical electrical plug receptacle including a cover plate are presented in front elevation view in FIG. 1. The following description will proceed with respect to the provision of an illumination assembly, according to the present invention, as such would be used on a conventional light switch.

Figure 2:
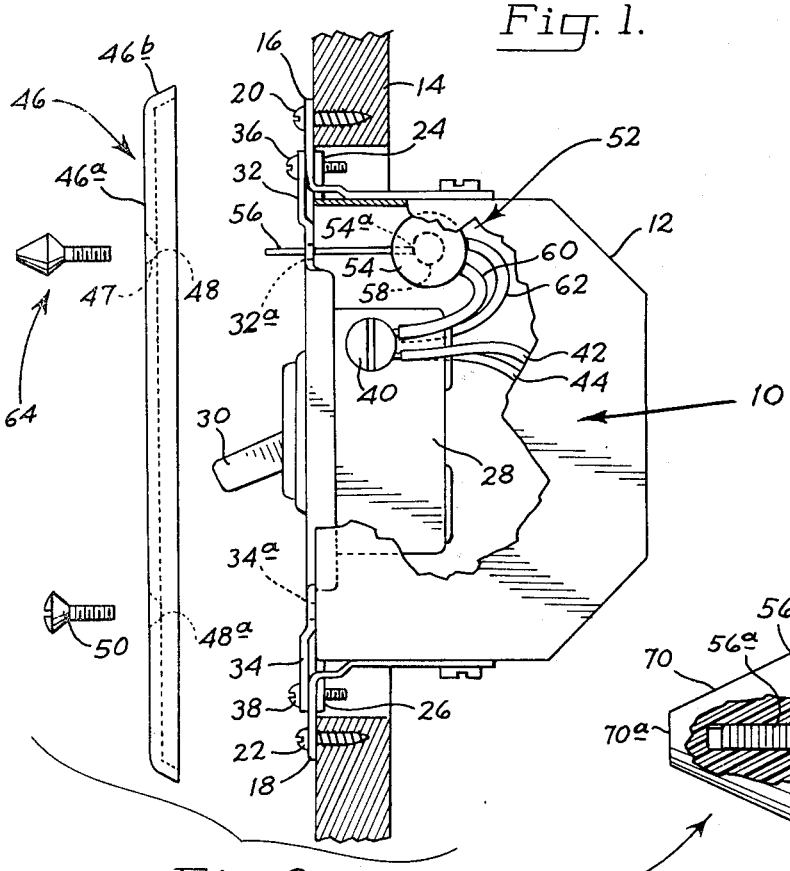
FIG. 2 is a side elevation view, partially broken away and exploded, illustrating mounting of the illumination assembly of the present invention in a conventional light switch terminal unit including a terminal box prior to mounting of a cover plate on the terminal unit.

For instance, a typical light switch is generally indicated at 10 in FIG. 2 and includes a conventional terminal box 12 which is mounted on an opening suitably provided in a wall 14. Upper and lower brackets 16, 18 respectively, are secured to terminal box 12 and receive conventional screw fasteners for mounting the terminal box to wall 14. As shown, screw fasteners 20, 22 extend through apertures provided in brackets 16, 18, respectively for securing the terminal box to the wall.

Additionally, terminal box 12 is provided with mounting lugs or fingers 24, 26 mounted on upper and lower portions of the terminal box, respectively, for receiving screw fasteners which mount an electrical terminal unit such as a toggle switch assembly. More particularly, a toggle switch assembly, of conventional construction, is indicated at 28 and includes a switch element 30. Suitable mounting brackets 32, 34 are provided on switch assembly 28 and include apertures for accommodating reception therethrough of screw fasteners 36, 38, respectively, for fastening the switch assembly to the fingers provided on terminal box 12. As is also conventional, a pair of opposed terminals, one of which is indicated at 40, are provided on switch assembly 28 for receiving power from a source (not shown) via conductors indicated at 42, 44.

A conventional removable cover plate for positioning in front of the switch assembly is indicated at 46 and includes beveled or inwardly sloping edges **46*a*, 46*b*, etc. Provided in cover plate 46 are spaced-apart apertures 48, 48*a*, which are alignable with threaded apertures provided in brackets 32, 34. For instance, bracket 32 is provided with a threaded aperture 32*a* and bracket 34 is provided with a threaded aperture 34*a*. As such, cover plate 46 may be mounted against wall 14 and suitable screw fasteners, one of which is indicated at 50 may be disposed through apertures in the cover plate, such as indicated at 48*a*, for securing the cover plate to the brackets provided on switch assembly 28**.

As shown in FIG. 2, cover plate 46 is exploded from its normal mounting position on terminal box 12 in order to permit illustration of the novel construction of the present invention. More particularly, and as referred to previously, the present invention is directed to an illumination assembly for facilitating visual determination of the situs of the switch assembly or cover plate so that the switch element is readily found. As such, the present invention is contemplated as being a "retrofit" which may be readily adapted to an existing terminal box without structural modification thereto. Accordingly, the present invention utilizes an illumination assembly, generally indicated at 52, which includes a light source 54 mounted adjacent the switch assembly and interiorly of terminal box 12 operable for producing illumination and an optical fiber means indicated at 56 communicating with light source 54 for transmitting illumination exteriorly of the terminal box. Elaborating further, it can be seen that light source 54 includes a dark or opaque casing within which is mounted a small lamp 58 such as a neon bulb. Electrical conductors such as indicated at 60, 62 are connected to the terminals of switch assembly 28 for providing current to lamp 58. Because lamp 58 is a small lamp, such as a pilot light of say, one quarter ($\frac{1}{4}$) watt, sufficient current will be directed across the terminals when switch element 30 is in the "off" position. As such, lamp 58 will be illuminated.

Turning to further details of light source 54, it can be seen that the casing of light source 54 is provided with an aperture **54*a* extending to lamp 58 for receiving optical fiber means 56. Thus, the optical fiber means may be positioned through aperture 32*a* and received by aperture 54*a* for contact against lamp 58. When lamp 58 is illuminated, light will be transmitted along optical fiber means 56. Further, as can be seen from a consideration of FIG. 2, optical fiber means 56 is dimensioned lengthwise for extending from light source 54 through aperture 32*a***, which aperture would normally accommodate reception of a screw fastener.

It is contemplated that when cover plate 46 is mounted on terminal box 12, optical fiber means 56 will be positioned with its left hand end extending through aperture 48 for reception within an illumination display means generally indicated at 64 for concentrating illumination from source 54. Explaining further, it can be seen that illumination display means 64 (also see FIG. 3) includes a first portion 66, provided with threads **66*a*, and an elongate bore 68 for accommodating reception therethrough of optical fiber means 56. Threads 66*a* are provided for threadably engaging with the threads provided within aperture 32*a* of bracket 32. Additionally, it should be noted that illumination display means 64 is provided with a transparent frusto-conical portion 70 and a rear beveled portion 72. Frusto-conical portion 70 and beveled portion 72 also are provided with an elongate bore aligned with bore 68 for receiving the optical fiber means. Beveled portion 72 is dimensioned for reception within a beveled screw recess 47 provided in cover plate 46**.

In order to mount illumination assembly 52, and the illumination display means, the following simplified steps are undertaken. Initially, it is assumed that cover plate 46 is mounted to terminal box 12 with conventional screw fasteners one of which is indicated at 50. The screw fasteners are removed, and cover plate 46 is detached from terminal box 12. Next, light source 54 and its conductors 62, 64 are mounted interiorly of the terminal box and the conductors are connected to the opposed terminals on toggle switch assembly 28. Optical fiber means 56, which may be a single optical fiber, is inserted through aperture **32*a* provided in bracket 32 and aperture 54*a* until a right hand end of the optical fiber is positioned against lamp 58. Cover plate 46 is then mounted against terminal box 12 and wall 14 so that optical fiber 56 extends through aperture 48 provided in the cover plate. Screw fastener 50 is then inserted through aperture 48*a* and secured to threaded aperture 34*a***.

Figure 3:
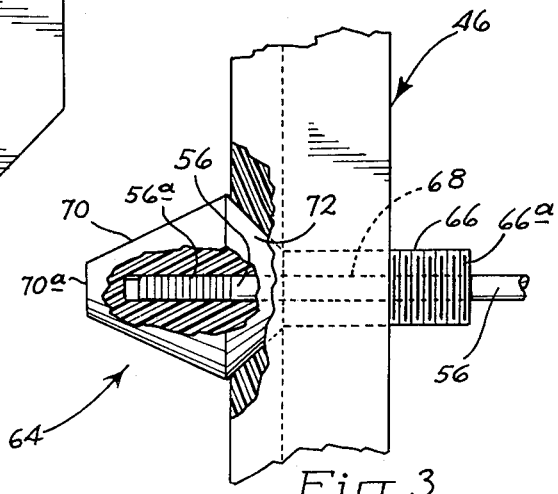
FIG. 3 is an enlarged view of a portion of the assembly, namely that portion including an illumination display means which is mounted adjacent the cover plate and doubles as a cover plate, fastener.

Next, by suitably gripping the frusto-conical portion of illumination display means 64 by one's fingers, first portion 66 may be threadably secured to threaded aperture **32*a* with optical fiber means 56 received in bore 68. As shown in FIG. 3, with illumination display means 64 in position, optical fiber means 56 extends into the illumination display means. Thus, the illumination display means doubles as a fastener for mounting cover plate 46 on terminal box 12 and also to concentrate illumination directly from optical fiber means 56 to a conical surface 70*a* of frusto-conical portion 70. Also, it is to be noted that the exterior surface of the left hand end of optical fiber means 56 is scored or suitably abraded, such as indicated at 56*a***, in order to provide a light refracting surface so that light may be directed from the sides of the optical fiber means. While a frusto-conical portion has been shown in this preferred embodiment, it must be realized that other shapes could be advantageously employed.

Figure 1:
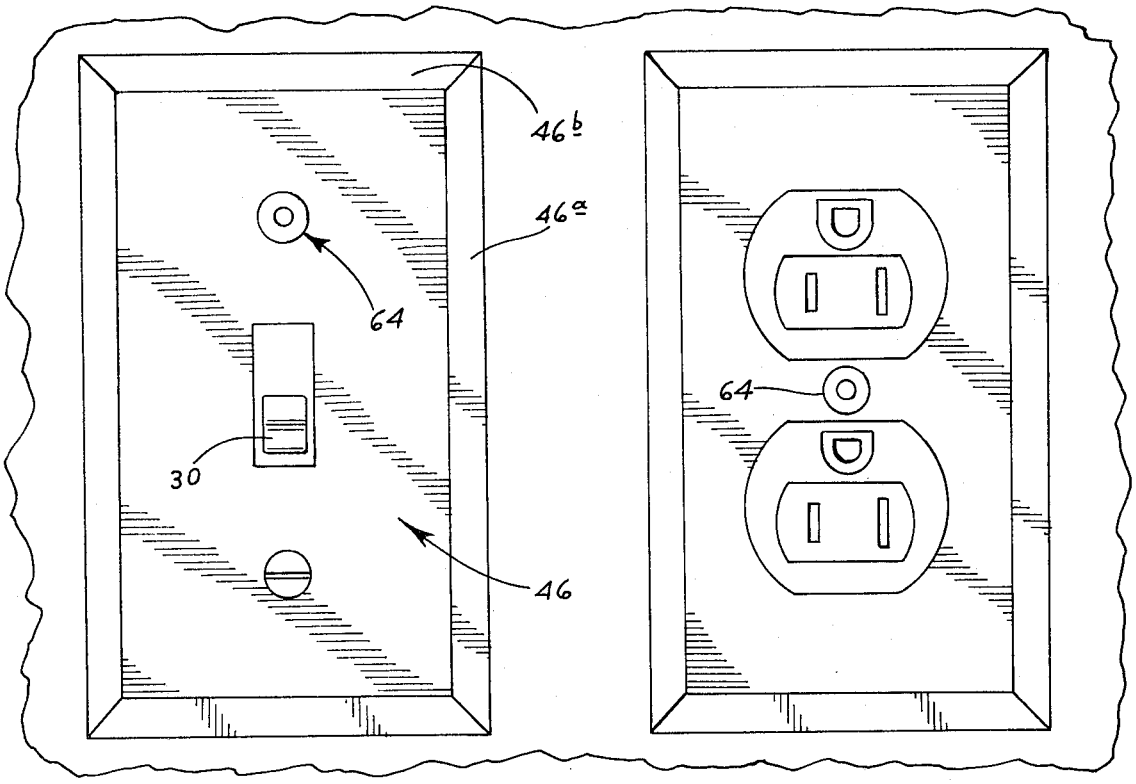
FIG. 1 is a front elevation view of a room light switch positioned adjacent an electrical receptacle showing mounting of the illumination assembly of the present invention.

Illumination display means 64 is shown in FIG. 1 with cover plate 46 suitably mounted over switch element 30. Similarly, an illumination display means may be mounted in the aperture provided in a cover plate which would normally accommodate a screw fastener for a electrical receptacle. This construction is shown in the right hand portion of FIG. 1 which includes an illumination display means mounted on a cover plate.

From the above description, it should be readily apparent that the illumination assembly of the present invention provides several distinct and important advantages. First of all, it is not necessary to structurally modify an electrical terminal unit or terminal box in order to provide a device for illuminating an electric light switch or receptacle. For instance, it is only necessary to provide a light source and an optical fiber means, as described above, which may be advantageously used in connection with an illumination display means doubling as a cover plate fastener. Of course, any type of cover plate may readily accommodate such an illumination assembly and it is virtually impossible for children to interfere with the light source. Additionally, the illumination assembly of the present invention is inexpensive and an individual may readily provide same in a terminal box.

A particular advantage resides from the fact that illumination display means 64 is of unitary construction. In other words, frusto-conical portion 70 and threaded portion 66 are of one piece which enables the unique provision of displaying light while simultaneously serving to fasten the cover plate. By providing such a unitary construction, the overall appearance of the cover plate remains generally unchanged. As a matter of fact, the frusto-conical portion adds attractiveness to a light switch or electrical plug receptacle.

Still another significant advantage of the illumination assembly results from use of optical fiber means 56. Such use permits a light source (such as lamp 58) to be mounted behind a cover plate. Thus, the light source does not encumber the appearance of a light switch or electrical plug receptacle. The optical fiber means, being small, unobtrusively permits light to be transmitted from the light source for viewing in front of the cover plate. The only dimensional requirements are that the optical fiber means be of a length sufficient for extending from the light source and outwardly through the cover plate.

While the present invention has been particularly described with reference to the foregoing preferred embodiment, it should be understood that other changes in form and detail may be made without departing from the spirit and scope of the invention as defined in the appended claims.

It is claimed and desired to secure by Letters Patent:

1. In an electrical terminal unit for mounting on a wall having a removable cover plate positioned in front thereof, an illumination assembly for facilitating visual determination of the situs of the unit comprising:

a light source mounted adjacent the unit and behind the cover plate operable for producing illumination;

optical fiber means communicating with said light source for transmitting illumination outwardly from the cover plate, said optical fiber means being dimensioned lengthwise for extending adjacent an aperture provided in the cover plate which normally accommodates reception of a fastener for mounting the cover plate adjacent the unit; and transparent display means disposed adjacent the end of said optical fiber means which extends adjacent the cover plate for concentrating illumination transmitted by said optical fiber means.

2. The assembly of claim 1, wherein said optical fiber means is dimensioned lengthwise for extending through an aperture provided in the cover plate.

3. The assembly of claim 1, wherein said display means includes a first portion having an elongate bore extending therethrough dimensioned for receiving said optical fiber means.

4. The assembly of claim 3 wherein said display means includes a frusto-conical portion connected to said first portion.

5. The assembly of claim 4 wherein said frusto-conical portion also includes an elongate bore longitudinally aligned with the bore in said first portion dimensioned for receiving said optical fiber means.

6. The assembly of claim 5 wherein said optical fiber means includes a scored portion for reception within the bore of said frusto-conical portion.

7. An illumination assembly for facilitating visual determination of the situs of an electrical terminal unit, the unit being mountable on a wall with a removable cover plate positioned in front thereof comprising:

a light source for mounting adjacent the unit and behind the cover plate operable for producing illumination;

optical fiber means communicating with said light source for transmitting illumination outwardly from the cover plate, and transparent display means disposed adjacent the end of said optical fiber means which extends through the cover plate for concentrating illumination transmitted by said optical fiber means and for mounting the cover plate adjacent the unit.

8. The assembly of claim 7 wherein said display means includes a first portion for positioning through an aperture provided in the cover plate which normally accommodates reception of a fastener for mounting the cover plate adjacent the unit, said first portion being adapted for fastening the cover plate adjacent the unit.

9. The assembly of claim 8 wherein said first portion includes an elongate bore extending therethrough dimensioned for receiving said optical fiber means.

10. The assembly of claim 8 wherein said display means includes a frusto-conical portion connected to said first portion.

11. The assembly of claim 9 wherein said frusto-conical portion also includes an elongate bore longitudinally aligned with the bore in said first portion dimensioned for receiving said optical fiber means.

12. The assembly of claim 11 wherein said optical fiber includes a scored portion for reception within the bore of said frusto-conical portion.

13. The assembly of claim 8 wherein said light source includes a casing enclosing a lamp, said casing being provided with an aperture for permitting reception therethrough of said optical fiber means so that said optical fiber means is disposed adjacent said lamp.

* * * * *